US007565188B2

(12) United States Patent
Akasegawa et al.

(10) Patent No.: US 7,565,188 B2
(45) Date of Patent: Jul. 21, 2009

(54) SUPERCONDUCTING FILTER DEVICE HAVING DISK RESONATORS EMBEDDED IN DEPRESSIONS OF A SUBSTRATE AND METHOD OF PRODUCING THE SAME

(75) Inventors: Akihiko Akasegawa, Kawasaki (JP); Kazuaki Kurihara, Kawasaki (JP); Kazunori Yamanaka, Kawasaki (JP); Shigetoshi Ohshima, Yonezawa (JP); Atsushi Saito, Yonezawa (JP)

(73) Assignee: Fujitsu Limited, Kawasaki (JP)

( * ) Notice: Subject to any disclaimer, the term of this patent is extended or adjusted under 35 U.S.C. 154(b) by 102 days.

(21) Appl. No.: 11/636,500

(22) Filed: Dec. 11, 2006

(65) Prior Publication Data

US 2008/0018421 A1 Jan. 24, 2008

(30) Foreign Application Priority Data

Jul. 24, 2006 (JP) ..... 2006-200792

(51) Int. Cl.
*H01P 1/20* (2006.01)
*H01B 12/02* (2006.01)

(52) U.S. Cl. ..... 505/210; 333/99 S; 333/202

(58) Field of Classification Search ..... 333/99 S, 333/202, 219; 505/210
See application file for complete search history.

(56) References Cited

U.S. PATENT DOCUMENTS

| | | | | |
|---|---|---|---|---|
| 6,021,337 | A * | 2/2000 | Remillard et al. | 505/210 |
| 6,263,220 | B1 * | 7/2001 | Mansour | 505/210 |
| 6,360,112 | B1 * | 3/2002 | Mizuno et al. | 505/210 |
| 6,941,650 | B2 * | 9/2005 | Nakakubo et al. | 29/849 |

FOREIGN PATENT DOCUMENTS

| | | |
|---|---|---|
| JP | 10-75103 | 3/1998 |
| JP | 2006-101187 | 4/2006 |

OTHER PUBLICATIONS

M. Morita, et al.; "Development of Oxide Superconductors—High-$T_c$Bulk Superconductor (QMG) and Its Magnetic Applications -;" *Nippon Steel Technical Report*; No. 383; 2005; pp. 16-20./Yes-Abstract/Discussed in the specification.

* cited by examiner

*Primary Examiner*—Benny T. Lee
(74) *Attorney, Agent, or Firm*—Fujitsu Patent Center

(57) ABSTRACT

A superconducting filter device is disclosed that is able to prevent current concentration and improve electrical surface resistance. The superconducting filter device includes a first dielectric substrate, and a bulk superconducting resonator that is embedded in the first dielectric substrate and is formed from a bulk superconducting material.

18 Claims, 9 Drawing Sheets

FIG.2A HTS thin film disk resonator
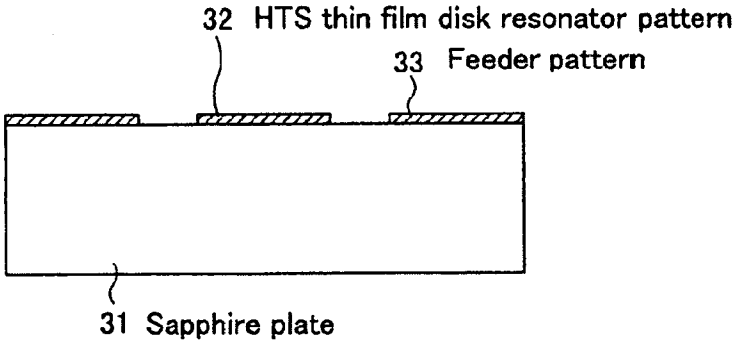
FIG.2B Not-embedded HTS bulk disk resonator
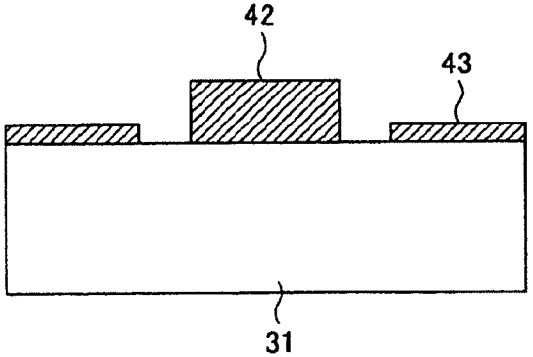
FIG.2C embedded HTS bulk disk resonator (without a taper)
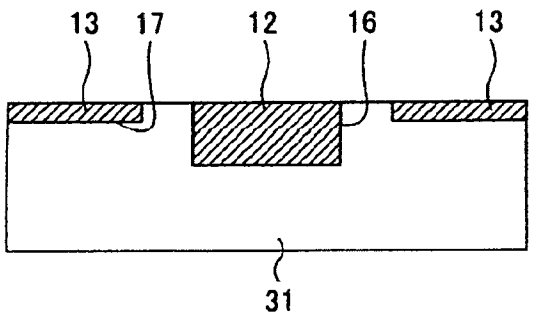
FIG.2D embedded HTS bulk disk resonator (with a taper: R=0.2)
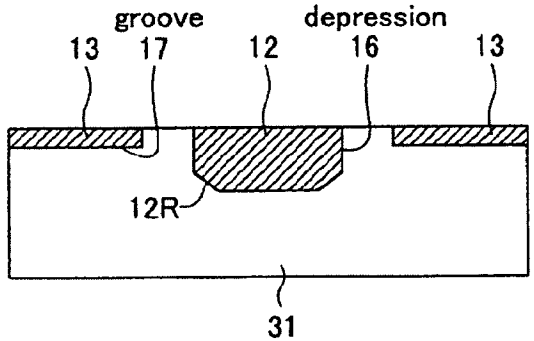

FIG.3

| Resonator structure | HTS thin film disk resonator | | not-embedded HTS bulk disk resonator | | embedded HTS bulk disk resonator (without a taper) | | embedded HTS bulk disk resonator (with a taper) | |
|---|---|---|---|---|---|---|---|---|
| Mode of Resonance | $TM_{21}$ | $TM_{01}$ | $TM_{21}$ | $TM_{01}$ | $TM_{21}$ | $TM_{01}$ | $TM_{21}$ | $TM_{01}$ |
| Diameter of Resonator [mm] | 18.4 | 22.6 | 17.8 | 20.8 | 15.8 | 19.2 | 15.8 R=0.2 | 19.2 R=0.2 |
| Max magnetic field [A/m] | 4062 | 1517 | 1487 | 351 | 412 | 144 | 292 | 151 |

$TM_{21}$ mode

Clamp size (Max: 4000)

Type : H-Field (peak)
Monitor : h-field (f=5.0088) [1]
Maximum-3d : 4062.07 A/m at 7.29655 / 4.9275 / 0.2505
Frequency : 5.0088
Phase : 135 degrees $H_{max.}$=4062 A/m $TM_{01}$ mode Clamp size (Max: 4000)

Type : H-Field (peak)
Monitor : h-field (f=4.9832) [1]
Maximum-3d : 1517.37 A/m at 3.76667 / 3.99 / 0
Frequency : 4.9832
Phase : 67.5 degrees $H_{max.}$=1517 A/m $TM_{21}$ mode Clamp size (Max: 4000)

| | |
|---|---|
| Type | • H-Field (peak) |
| Monitor | • h-field (f=4.9936) [1] |
| Maximum-3d | • 1486.82 A/m at -5.08571 / 7.04545 / 1.54394 |
| Frequency | • 4.9936 |
| Phase | • 90 degrees |

$H_{max.}$=1487 A/m $TM_{01}$ mode

Clamp size (Max: 4000)

| | |
|---|---|
| Type | • H-Field (peak) |
| Monitor | • h-field (f=5.002) [1] |
| Maximum-3d | • 350.503 A/m at -3.9 / 3.9375 / 0 |
| Frequency | • 5.002 |
| Phase | • 90 degrees |

$H_{max.}$=351 A/m $TM_{21}$ mode

Clamp size (Max: 4000)

Type • H-Field (peak)
Monitor • h-field (f=5.01) [1]
Maximum-3d • 412.242 A/m at -5.372 / 5.5 / 1.5
Frequency • 5.01
Phase • 0 degrees $H_{max.}$=412 A/m $TM_{01}$ mode Clamp size (Max: 4000)

Type • H-Field (peak)
Monitor • h-field (f=5.0116) [1]
Maximum-3d • 143.65 A/m at 3.84 / 3.9375 / 0
Frequency • 5.0116
Phase • 22.5 degrees $H_{max.}$=144 A/m FIG.7A
$TM_{21}$ mode
Clamp size (Max: 4000)
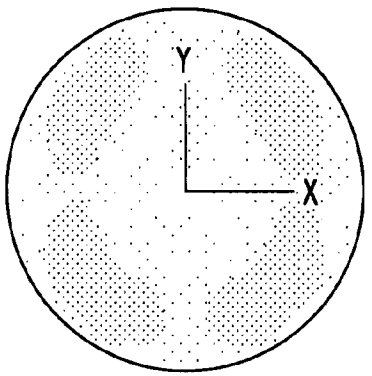
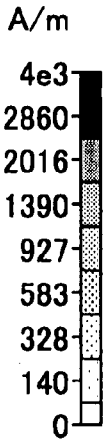
Type • H-Field (peak)
Monitor • h-field (f=5.008) [1]
Maximum-3d • 291.536 A/m at -7.05267 / 2.97434 / 1.8
Frequency • 5.008
Phase • 0 degrees
$H_{max.}$=291.5 A/m
FIG.7B
$TM_{01}$ mode
Clamp size (Max: 4000)
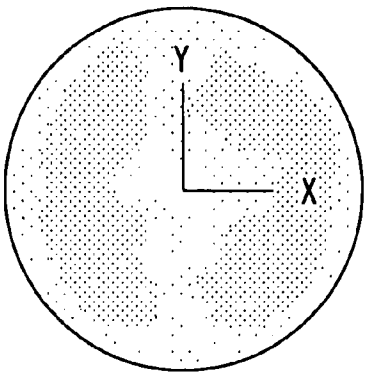
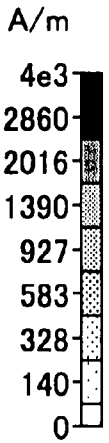
Type • H-Field (peak)
Monitor • h-field (f=5.0172) [1]
Maximum-3d • 150.601 A/m at 3.32315 / 3.70394 / 0
Frequency • 5.0172
Phase • 22.5 degrees
$H_{max.}$=150.6 A/m

SUPERCONDUCTING FILTER DEVICE HAVING DISK RESONATORS EMBEDDED IN DEPRESSIONS OF A SUBSTRATE AND METHOD OF PRODUCING THE SAME

CROSS-REFERENCE TO RELATED APPLICATION

This patent application is based on Japanese Priority Patent Application No. 2006-200792 filed on Jul. 24, 2006, the entire contents of which are hereby incorporated by reference.

BACKGROUND OF THE INVENTION

1. Field of the Invention

The present invention relates to a superconducting filter device, particularly, to a superconducting filter device having an embedded bulk superconducting resonator, and a method of fabricating the superconducting filter device.

2. Description of the Related Art

In recent years and continuing, along with transition to high speed, large capacity data communications such as the next generation mobile communication system, and a wide-band wireless access system, effective utilization of frequency resources becomes indispensable. A leading candidate for solving the frequency interference problem is using a high-Q superconducting filter, which has low loss and good frequency cutoff characteristics, for both signal reception and signal transmission.

A micro-strip line structure is often used in a superconducting receive filter. However, when receiving a high-power RF signal, loss in the filter increases. This is because microwaves or other high frequency signals are likely to concentrate at an edge of a conductor, hence electric currents are concentrated at edges or corners of the micro-strip lines, and the current density exceeds the critical current density of the superconductor.

As a candidate of a superconducting transmit filter, a disk type resonator pattern has been developed, which is able to prevent current concentration, and thus has a very uniform current density distribution. For example, Japanese Laid Open Patent Application No. 2006-101187 discloses such a technique.

In addition, attempts have been made to reduce the concentration of the current density by increasing the film thickness of a superconducting film. However, when the film thickness of the superconducting film is increased, the crystallinity of the superconducting film declines, so that the electrical surface resistance of the superconducting film does not improve as expected. A high temperature oxide superconductor thin film, such as a YBCO film, is often formed by CVD (Chemical Vapor Deposition), such as MOCVD (Metal Organic Chemical Vapor Deposition), and the crystallinity of the film declines along with growth.

On the other hand, a bulk superconducting material, which is nearly a single crystal, has recently become available, and it is reported that the bulk superconducting material is used in a bulk magnet to serve as a magnetic field generator. For example, reference can be made to "Development of Oxide Superconductor—Bulk Superconducting Material (QMG) and its Magnetic Application", Morita et al, Nippon Steel Technical Report, No. 383 (2005), pp. 16-20.

The bulk superconducting material, which has good crystallinity close to a single crystal, is applicable to not only magnets but also various other devices, and it is a hot issue how to apply the bulk superconducting material to actual devices.

SUMMARY OF THE INVENTION

The present invention may solve one or more of the problems of the related art.

A preferred embodiment of the present invention may provide a superconducting filter device which is formed by applying a bulk superconducting material to a high frequency transmitting filter, able to reduce loss caused by current concentration, and able to improve electrical surface resistance.

Another preferred embodiment of the present invention may provide a method of producing said superconducting filter device.

According to a first aspect of the present invention, there is provided a superconducting filter device, comprising:

a first dielectric substrate; and a bulk superconducting resonator that is embedded in the first dielectric substrate and is formed from a bulk superconducting material.

As an embodiment, the bulk superconducting resonator has a taper at an edge thereof.

As an embodiment, the superconducting filter device further comprises:

a feeder that extends near the bulk superconducting resonator for use of signal input and signal output, wherein the feeder is formed from a bulk superconducting material, and is embedded in the first dielectric substrate.

As an embodiment, the superconducting filter device further comprises:

a plurality of the bulk superconducting resonators each resonator embedded in the first dielectric substrate and formed from a bulk superconducting material; and a plurality of coupling lines that couple two adjacent ones of the bulk superconducting resonators, wherein the coupling lines are formed from a bulk superconducting material, and are embedded in the first dielectric substrate.

As an embodiment, the superconducting filter device further comprises:

a second dielectric substrate arranged on the bulk superconducting resonator embedded in the first dielectric substrate.

According to the above embodiments, since the bulk superconducting resonator is embedded in the dielectric substrate, it is possible to highly effectively prevent current concentration compared to the case in which the bulk superconducting resonator is simply arranged on the dielectric substrate.

In addition, since the superconducting resonator is formed from a bulk superconducting material, it is possible to reduce the concentration of currents and improve the electrical surface resistance.

In addition, since the edge is processed to be a taper, it is possible to further reduce current concentration at the edge.

In addition, since the feeder is formed from a bulk superconducting material, it is possible to increase coupling between the resonator and the feeder line, and prevent current concentration at the feeder.

In addition, since a second dielectric substrate is arranged on the bulk superconducting resonator, it is possible to fix the bulk superconducting resonator and prevent current concentration on the surface of the bulk superconducting resonator.

According to a second aspect of the present invention, there is provided a superconducting filter device production method, comprising the steps of:

fabricating a superconducting disk having a predetermined thickness from a cylindrical bulk superconducting material;

forming a depression portion in a first dielectric substrate to have a size equivalent to the superconducting filter disk; and embedding the superconducting filter disk in the depression portion to form an embedded bulk superconducting resonator.

As an embodiment, the step of fabricating a superconducting disk includes a step of:

forming a taper at an edge of the superconducting disk.

As an embodiment, the method further comprises the steps of:

cutting out a feeder for use of signal input and signal output from the bulk superconducting material;

forming a groove extending near the depression portion corresponding to a shape of the feeder in the first dielectric substrate; and embedding the feeder in the groove.

As an embodiment, the method further comprises the step of arranging a second dielectric substrate on the bulk superconducting resonator embedded in the first dielectric substrate.

As an embodiment, the depression portion is fabricated by laser machining or ultrasonic machining.

As an embodiment, the groove is fabricated by laser machining or ultrasonic machining.

As an embodiment, the taper has a curvature radius of 0.2 mm.

According to the above embodiments, it is known that a bulk superconducting material can be formed to have various diameters by melting, and such a bulk superconducting material can be machined to have a preset thickness. By applying such a bulk superconducting material to a high frequency transmitting filter, it is possible to prevent current concentration on a resonator.

Therefore, it is possible to reduce the maximum current density and improve the electrical surface resistance.

These and other objects, features, and advantages of the present invention will become more apparent from the following detailed description of the preferred embodiments given with reference to the accompanying drawings.

BRIEF DESCRIPTION OF THE DRAWINGS

FIG. 2A through FIG. 2D are cross-sectional views illustrating four superconducting filter devices which are used as samples in measurements of the current density (magnetic field) distribution;

FIG. 3 is a table summarizing the measurement results of the maximum current density of the four samples shown in FIG. 2;

FIG. 7A and FIG. 7B are diagrams illustrating the current density distribution of the sample shown in FIG. 2D in the TM21 mode and the TM01 mode.

DESCRIPTION OF THE PREFERRED EMBODIMENTS

Below, preferred embodiments of the present invention are explained with reference to the accompanying drawings.

Figure 1A:
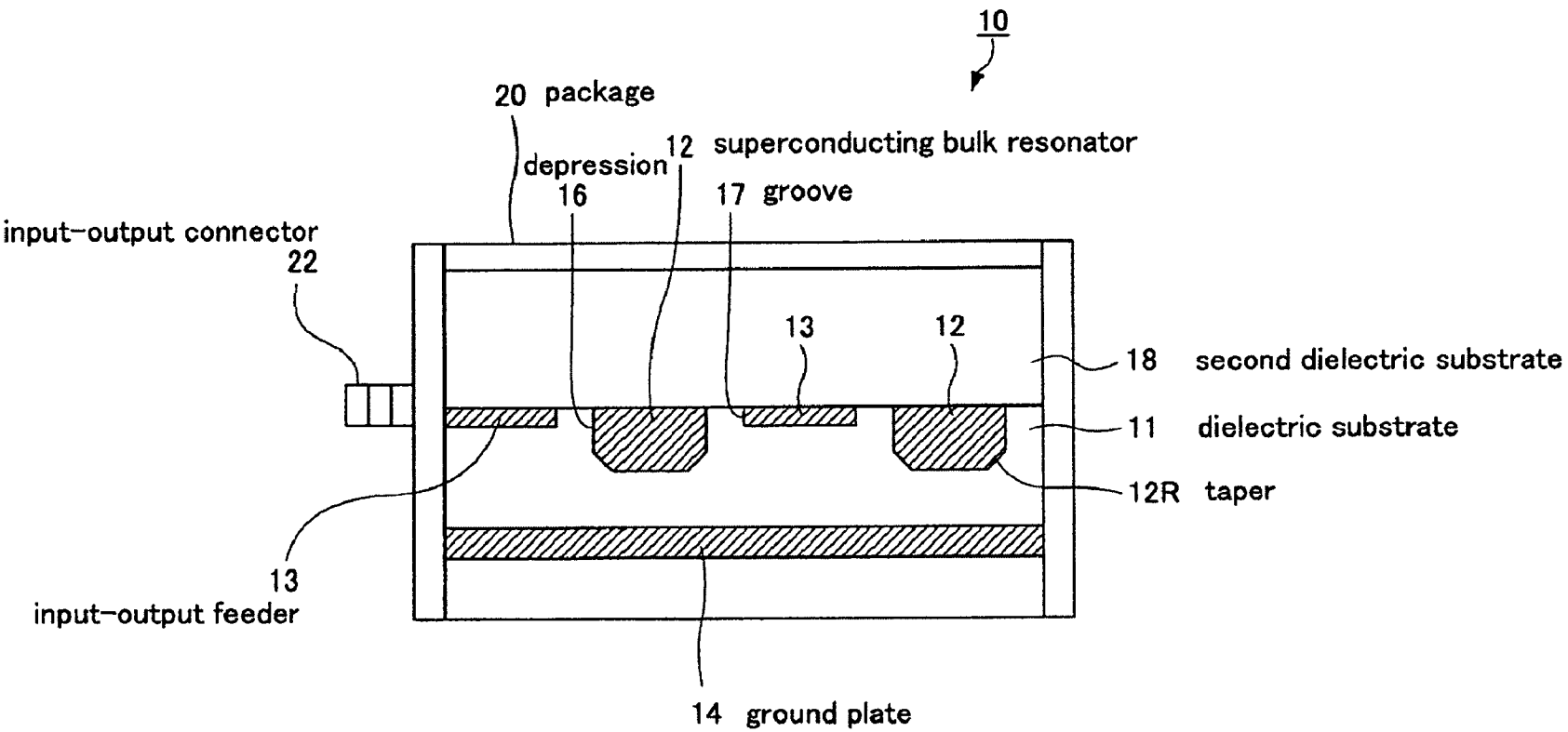
FIG. 1A and FIG. 1B are a schematic cross-sectional view and a perspective view illustrating a configuration of a superconducting filter device 10 according to an embodiment of the present invention.
Figure 1B:
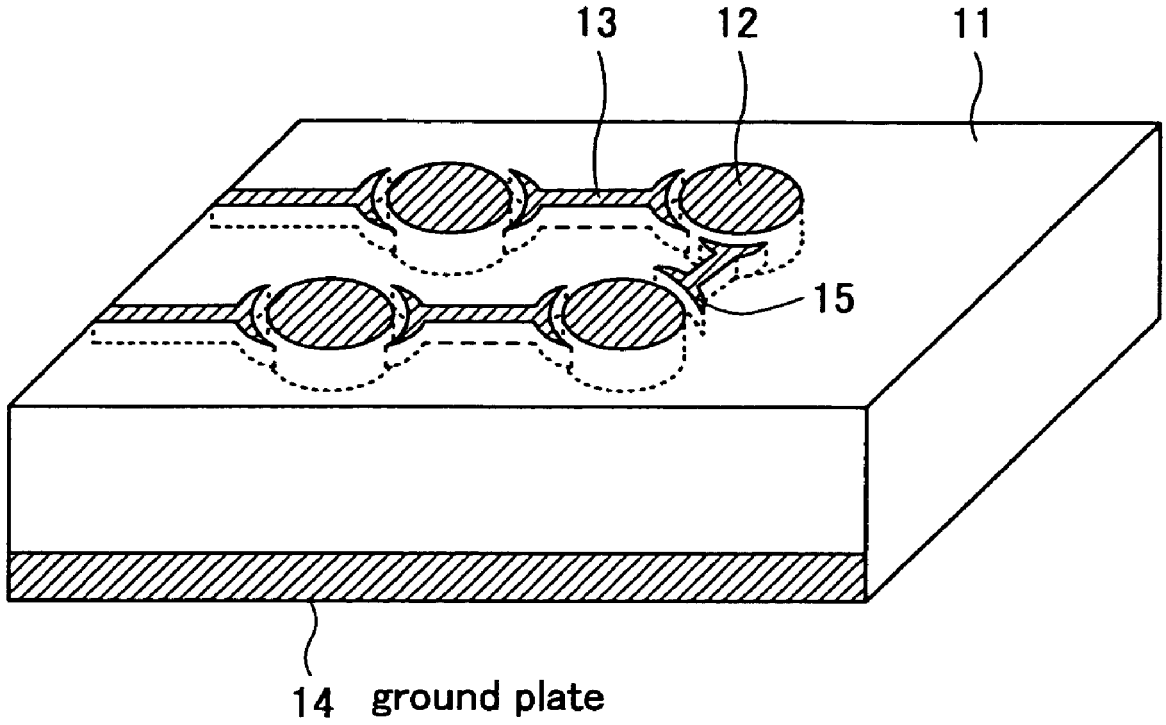

FIG. 1A and FIG. 1B are a schematic cross-sectional view and a perspective view illustrating a configuration of a superconducting filter device 10 (FIG. 1A) according to an embodiment of the present invention.

For example, the superconducting filter device 10 is held in a metal package 20 (FIG. 1A) and is used as a high frequency transmit filter in a base station in a mobile communication system.

For example, the superconducting filter device 10 has a dielectric substrate 11 which is formed from a sapphire single crystal, a bulk superconducting resonator 12 which is formed from a bulk superconducting material embedded in the dielectric substrate 11, a signal input-output line (below, referred to as "feeder") 13 arranged to extend near the bulk superconducting resonator 12, and a ground electrode (below, referred to as "ground plate") 14 formed on the back surface of the dielectric substrate 11.

For example, the bulk superconducting resonator 12 is formed from a high temperature bulk superconductor, such as YBCO (Y—Ba—Cu—O) based materials. For example, the bulk superconductor may be a disk having a diameter of 10 mm and a thickness of 0.3 mm, and is embedded in a depression 16 of the dielectric substrate 11. In this sense, the superconducting resonator 12 is referred to as an "embedded bulk HTS resonator" where necessary.

The upper surface of the embedded bulk HTS resonator 12 is shaped to be a two dimensional circuit pattern (for example, a disk pattern), which is expected to be suitable for signal transmission.

In the present application, the term "two-dimension circuit pattern" or "pattern of a two dimensional circuit" is used to have a different meaning from a line pattern or a strip pattern (one-dimension pattern), which means a planar pictorial pattern having a certain extension, such as a circle, an ellipse, or a polygonal shape.

There is a taper 12R on the bottom of the embedded bulk HTS resonator 12. In this embodiment, by only embedding the bulk superconductor disk in the dielectric substrate 11, the current density can be sufficiently reduced. Nevertheless, as described below, by further forming a taper at the edge of the bulk superconductor disk, the current density can be further reduced.

One end of the signal input-output feeder 13 is used for inputting signals, and the other end of the signal input-output feeder 13 is used for outputting signals. In the example shown in FIG. 1, the feeder 13 is also formed from a bulk superconducting material, and is embedded in a groove 17 (FIG. 1A) formed in the dielectric substrate 11. The feeder 13 may be formed from a thin film. By embedding the feeder 13 in the dielectric substrate 11, it is possible to prevent current density concentration at the feeder 13, and strengthen the coupling between the resonator 12 and the feeder line 13. The feeder 13 is connected to an input-output connector 22 (FIG. 1A) provided on the metal package 20.

As shown in FIG. 1B, plural embedded bulk HTS disk resonators 12 may be arranged in the dielectric substrate 11, and adjacent resonators 12 can be coupled by coupling lines 15. Preferably, the coupling lines 15 are also formed from a bulk superconducting material, and are embedded in the dielectric substrate 11.

The superconducting filter device 10 can be fabricated as below.

First, a cylindrical bulk superconducting material is cut into slices each having a specified thickness and the bulk superconducting material slices are made into the bulk HTS disk resonators 12. The bulk superconducting material may be RE-Ba—Cu—$O_{7-\delta}$ manufactured by Nippon Steel. Here, "RE" represents a rare-earth element, such as Y (yttrium), Dy (dysprosium), or Gd (gadolinium). "δ" is an integral number satisfying $0 \leqq \delta \leqq 6$. Currently, a bulk superconducting material having a diameter up to 85 mm and a thickness up to 20 mm is commercially available. In the present embodiment, for example, a bulk superconducting material having a diameter of 10 mm is machined into slices, and further into disks each having a thickness of 0.3 mm.

Next, the taper 12R (FIG. 1A) having a certain taper angle (for example, R=0.2 mm) is formed along the edge of the upper surface or lower surface of the thus obtained bulk superconducting disk.

Next, the depression 16 (FIG. 1A) is formed in the dielectric substrate 11, which has a size corresponding to the diameter and thickness of the bulk HTS disk resonator 12, and the bulk HTS disk resonator 12 is embedded in the depression 16. For example, the depression 16 is fabricated by laser machining or ultrasonic machining.

Next, if the feeder 13 is also to be embedded, in addition to the depression 16 for the bulk HTS resonator 12, the groove 17 is also formed in the dielectric substrate 11. For example, the feeder 13 can be formed by dicing a bulk HTS wafer, that is, a bulk HTS slice having a specified thickness.

After embedding the bulk HTS disk resonator 12 and the feeder 13 in the dielectric substrate 11, preferably, a second dielectric plate 18 (FIG. 1A) is arranged on the dielectric substrate 11 to fix the embedded bulk HTS disk resonator 12 and the feeder 13. In addition, with the second dielectric substrate being provided, it is possible to prevent current concentration on the surface of the embedded bulk HTS disk resonator 12.

In the present embodiment, since a bulk superconducting material having a certain thickness is used, it is possible to reduce the concentration of currents on the resonator 12 and improve the electrical surface resistance.

Next, a comparison of the current density reduction effect is made between the embedded bulk HTS disk resonator 12 of the present embodiment, a thin film disk resonator, and a bulk HTS disk resonator placed on the dielectric substrate 11 (that is, a not-embedded bulk HTS resonator).

FIG. 2A through FIG. 2D are cross-sectional views illustrating four superconducting filter devices which are used as samples in measurements of the current density (magnetic field) distribution.

The magnetic field distributions are measured with the four samples shown in FIG. 2A through FIG. 2D. From the measurement results, surface current density distributions are obtained, and comparison of the surface current density distributions is made. For each sample, the measurements are made in a TM01 mode, in which the magnetic field extends in a radial direction, and a TM21 mode, in which the current density is likely to concentrate at an edge of the bulk HTS disk.

Specifically, FIG. 2A shows a superconducting filter device including a HTS thin film disk resonator. This superconducting filter device is fabricated as below. First, a superconducting thin film having a thickness of 1 μm is deposited, by sputtering or CVD, to entirely cover a sapphire plate 31, and then a circular resonator pattern 32 and a feeder pattern 33 are formed by lithography.

FIG. 2B shows a superconducting filter device including a not-embedded HTS bulk disk resonator. This superconducting filter device is fabricated as below. A bulk superconducting material is sliced to have a specified thickness, and a bulk HTS disk resonator 42 and a bulk HTS feeder 43 are produced; then, the bulk HTS disk resonator 42 and the bulk HTS feeder 43 are arranged on the sapphire plate 31.

FIG. 2D shows a superconducting filter device including an embedded HTS bulk disk resonator 12 with the taper 12R. This superconducting filter device is fabricated as below. A bulk superconducting material is sliced to obtain a disk having a specified thickness, and a depression 16 with the taper 12R and a groove 17 are formed in the sapphire plate 31. Then, the taper 12R (for example, R=0.2 mm) is formed at the edge of the bulk superconducting disk, thereby forming the HTS bulk disk resonator 12 with the taper 12R, and the HTS bulk disk resonator 12 with the taper 12R and a feeder 13 are embedded in the depression 16 and the groove 17, respectively, formed in the sapphire plate 31.

FIG. 2C shows a superconducting filter device including the embedded HTS bulk disk resonator 12, without taper. This superconducting filter device is fabricated as below. A bulk superconducting material is sliced to have a specified thickness, and the bulk HTS disk resonator 12 and the feeder 13 are embedded in the sapphire plate 31.

FIG. 3 is a table summarizing the measurement results of the maximum current density of the four samples shown in FIG. 2.

In FIG. 3, the samples have different diameters in different modes. This is because in both the TM21 mode and the TM01 mode of each of the samples, it is set that the resonance state occurs at a center frequency of 5 GHz.

The measurement results in the table in FIG. 3 reveal that the maximum magnetic field (current density) is reduced effectively by using the embedded HTS bulk disk resonator 12. Especially, with the HTS bulk disk resonator 12 having the taper 12R on its bottom, the maximum magnetic field (current density) is reduced greatly in the TM21 mode, in which the current is likely to concentrate at edge of the disk.

In addition, since it is set that the resonance mode occurs at the same center frequency of 5 GHz, the diameter of the bulk disk resonator can be made small compared to the thin film resonator, and by using the embedded bulk disk resonator, the diameter can be made even smaller. In other words, by using the embedded bulk disk resonator, the device can be made compact.

Figure 4A:
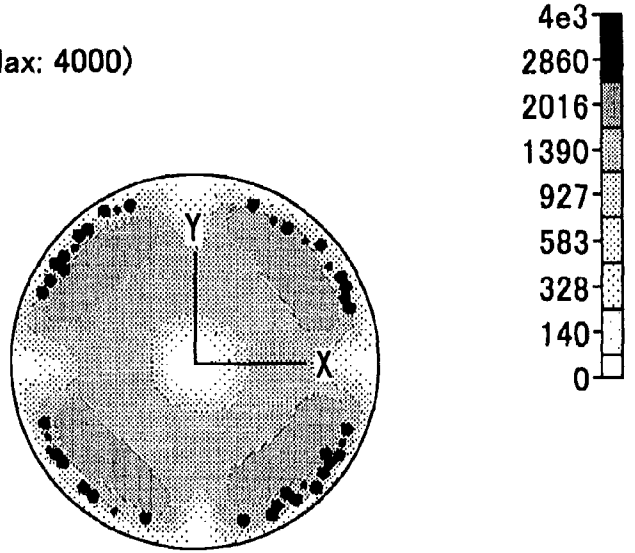
FIG. 4A and FIG. 4B are diagrams illustrating the current density distribution of the sample shown in FIG. 2A in the TM21 mode and the TM01 mode.
Figure 4B:
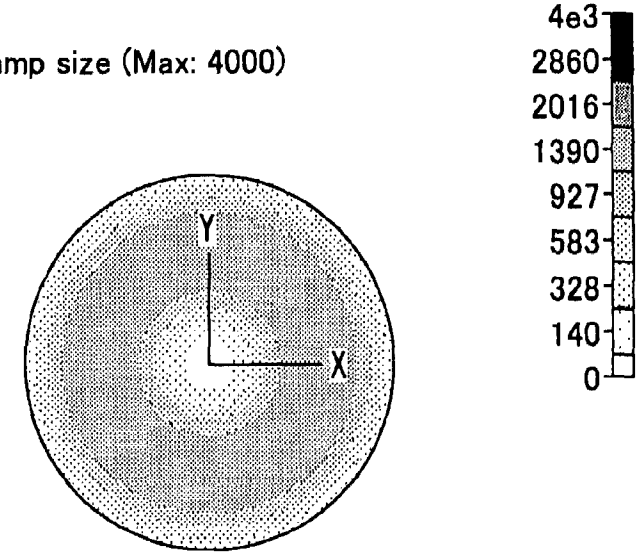

FIG. 4A and FIG. 4B are diagrams illustrating the current density measured as magnetic field distribution of the sample shown in FIG. 2A in the TM21 mode and the TMO1 mode, respectively. In FIG. 4A, for example, "Clamp size (Max: 4000)" indicates that the maximum magnetic field clamped is 4000 A/m; "Type H-Field (peak)" indicates that the peak of magnetic field was measured; "Monitor h-field (f=5.0088)" indicates that the magnetic field at frequency of 5.0088 GHz was measured: "Maximum-3d 4062.07 A/m at 7.29655/4.9275/0.2505" indicates that the maximum of the magnetic field $H_{max}$ was 4062.07 A/m which was measured at radiuses of 7.29655, 4.9275 and 0.2505 mm; "Frequency 5.0088" indicates that the measurement was made at the frequency of 5.0088 GHz: and "Phase 135 degrees" indicates that the phase difference of input and output was 135 degree. The terms, "Type," "Monitor," "Maximum-3d," "Frequency" and "Phase" in FIGS. 4B, 5A, 5B, 6A, 6B, 7A and 7B indicate the same meanings as above albeit with values which differ in the respective drawing figures. In the TM21 mode, the current is likely to concentrate along the edge of the thin film.

Figure 5A:
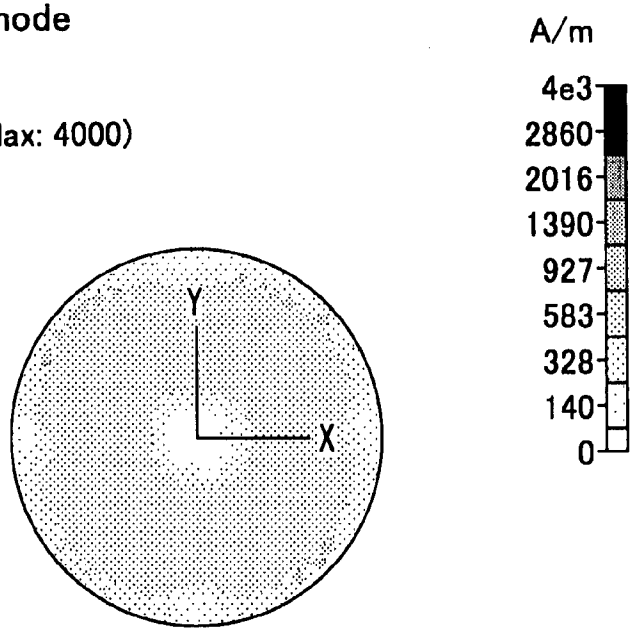
FIG. 5A and FIG. 5B are diagrams illustrating the current density distribution of the sample shown in FIG. 2B in the TM21 mode and the TM01 mode.
Figure 5B:
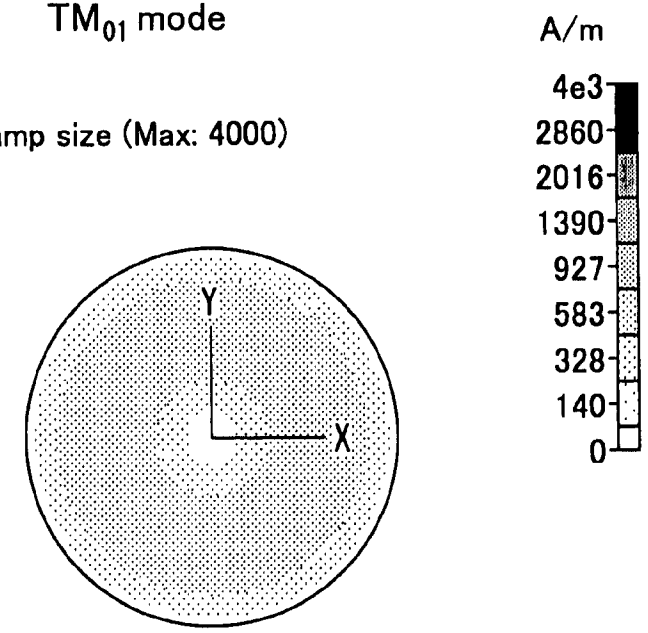

FIG. 5A and FIG. 5B are diagrams illustrating the current density distribution of the sample shown in FIG. 2B in the TM21 mode and the TM01 mode.

Comparing the results in FIG. 4A and FIG. 4B with the results in FIG. 5A and FIG. 5B, it is clear that by using the bulk superconducting resonator, the current density distribution on the surface of the bulk superconducting resonator is relatively uniform compared to the thin film resonator.

Figure 6A:
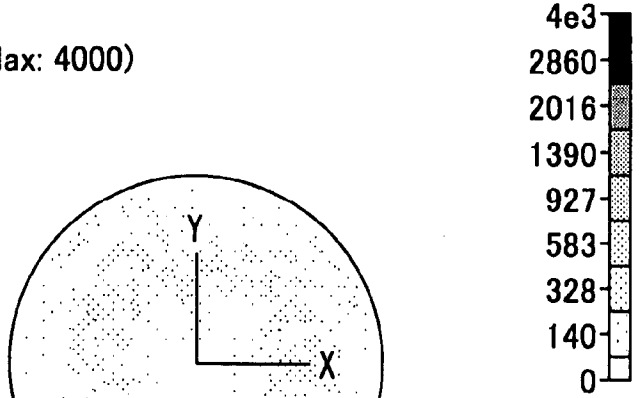
FIG. 6A and FIG. 6B are diagrams illustrating the current density distribution of the sample shown in FIG. 2C in the TM21 mode and the TM01 mode.
Figure 6B:
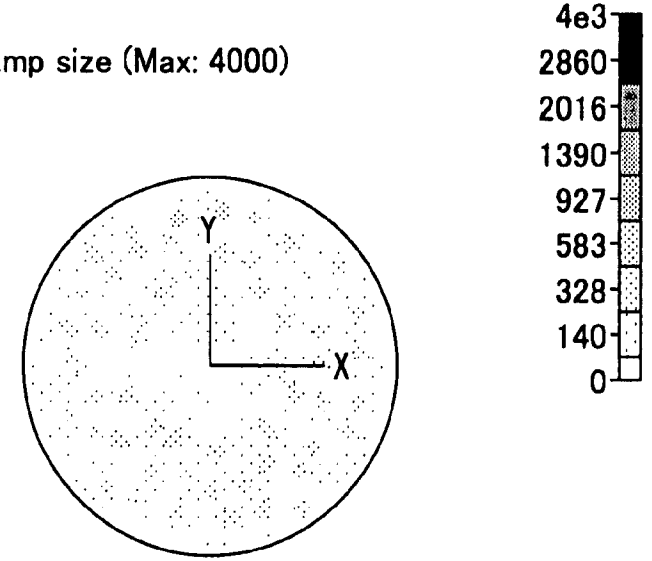

FIG. 6A and FIG. 6B are diagrams illustrating the current density distribution of the sample shown in FIG. 2C in the TM21 mode and the TM01 mode.

Comparing the results in FIG. 6A and FIG. 6B with the results in FIG. 4A and FIG. 4B, and the results in FIG. SA and FIG. 5B, it is clear that by using the embedded bulk superconducting resonator, the current density distribution on the surface of the bulk superconducting resonator becomes relatively uniform; further, the maximum current density is greatly reduced.

FIG. 7A and FIG. 7B are diagrams illustrating the current density distribution of the sample shown in FIG. 2D in the TM21 mode and the TM01 mode.

Comparing the results in FIG. 7A and FIG. 7B with the results in FIG. 4A and FIG. 4B, the results in FIG. 5A and FIG. 5B, and the results in FIG. 6A and FIG. 6B, it is clear that by using the embedded bulk superconducting resonator with the taper, especially in the TM21 mode, the maximum current density is further greatly reduced.

Figure 8A:
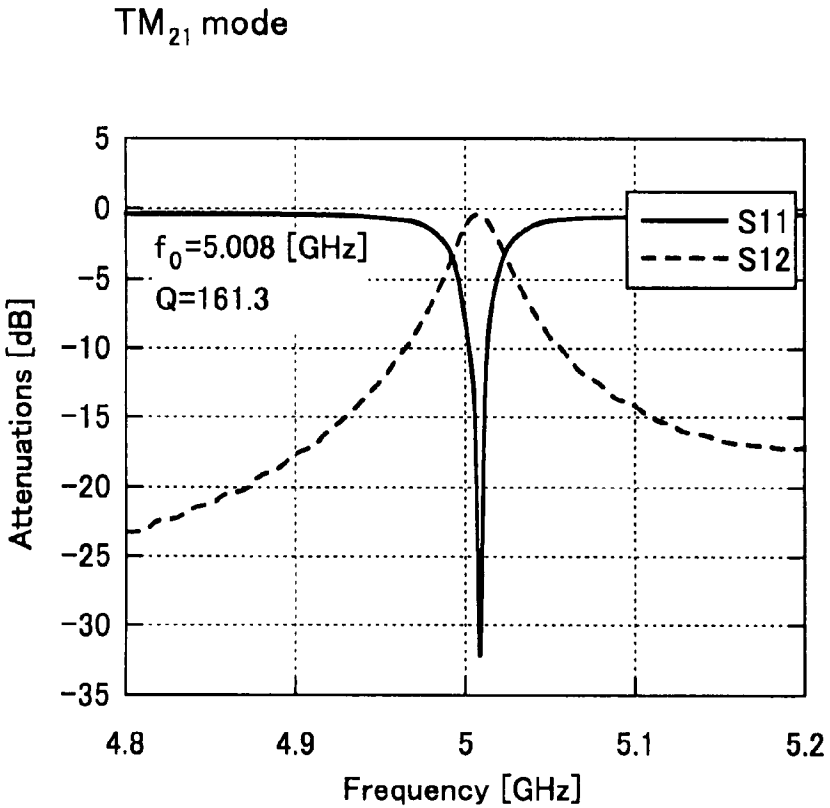
FIG. 8A and FIG. 8B are graphs illustrating characteristics of the superconducting filter device 10 of the present embodiment, which includes the embedded HTS bulk disk resonator with the taper, as shown in FIG. 2D.
Figure 8B:
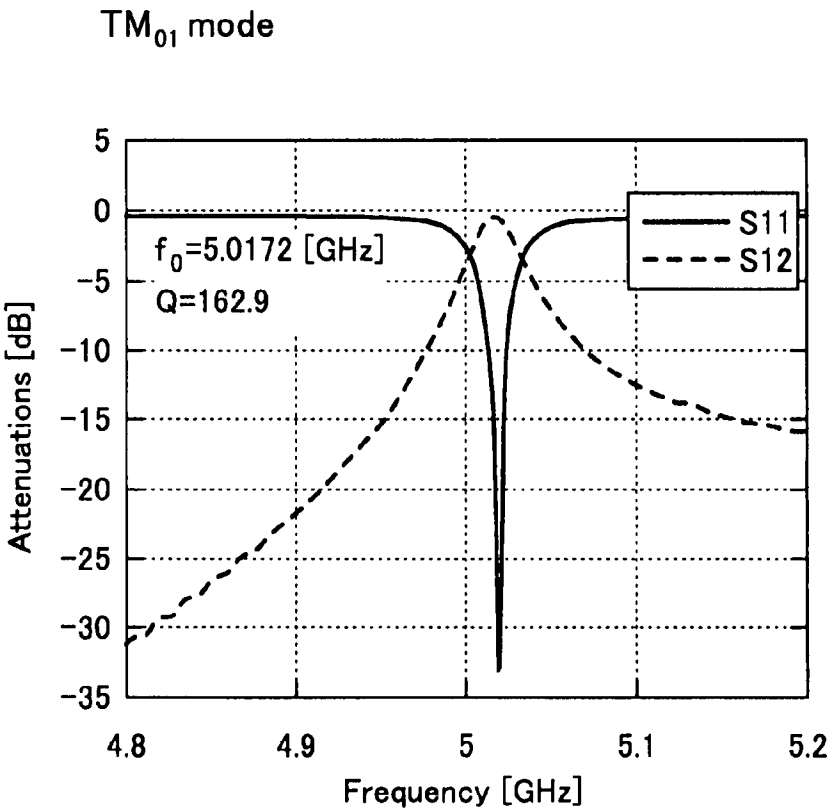

FIG. 8A and FIG. 8B are graphs illustrating characteristics of the superconducting filter device 10 of the present embodiment, which device 10 includes the embedded HTS bulk disk resonator 12 with the taper 12R, as shown in FIG. 2D.

Specifically, FIG. 8A shows the reflection characteristics (S11) and the transmission characteristics (S12) in the TM21 mode; FIG. 8B shows the reflection characteristics (S11, or solid line) and the transmission characteristics (S12, or broken line) in the TM01 mode. In FIGS. 8A and 8B, the longitudinal axes indicate attenuations in dB and the transverse axes indicates frequencies in GHz. The terms "f0" indicates the frequency at which the resonance occurs and "Q" indicates the Q factor. In particular, FIGS. 8A and 8B depict sharp resonances at f0=5.008 GHz and f0=5.0172 GHz, respectively, with Q=161.3 and Q=162.9, respectively.

As shown in FIG. 8A and FIG. 8B, the superconducting filter device 10 shows good performance in both the TM21 mode and the TM01 mode.

As described above, according to the present embodiment, by using the embedded bulk superconducting resonator, it is possible to highly effectively reduce the current density, improve the electrical surface resistance, reduce the size of the filter device, and strengthen the coupling between the resonator and the feeder line.

While the invention is described above with reference to specific embodiments chosen for purpose of illustration, it should be apparent that the invention is not limited to these embodiments, but numerous modifications could be made thereto by those skilled in the art without departing from the basic concept and scope of the invention.

The upper surface of the bulk superconducting resonator is not limited to a circular shape, but may be any two dimensional circuit pattern, such as an ellipse or a polygonal shape.

For example, it is described that YBCO (Y—Ba—Cu—O) based materials are used as the superconducting material of the bulk superconducting resonator 12, but the present invention is not limited to the bulk YBCO based material, and any oxide superconducting material can be used. For example, thin films of bulk RBCO (R—Ba—Cu—O) based materials can be used. That is, as the R element, instead of Y (Yttrium), Nd, Sm, Gd, Dy, Ho can be used in the superconducting material. In addition, bulk BSCCO (Bi—Sr—Ca—Cu—O) based materials, bulk PBSCCO (Pb—Bi—Sr—Ca—Cu—O) based materials, and bulk CBCCO (Cu—$Ba_p$—$Ca_q$—$Cu_r$—$O_x$) based materials (where, $1.5<p<2.5$, $2.5<q<3.5$, $3.5<r<4.5$) can also be used as the superconducting materials.

The dielectric substrate 11 is not limited to the sapphire substrate. For example, the dielectric substrate 11 may be a $LaAlO_3$ substrate, or a MgO substrate.

In addition, a second dielectric plate may be arranged on the embedded bulk HTS disk resonator 12 and the feeder 13.

What is claimed is:

1. A superconducting filter device, comprising:

a first dielectric substrate; and a bulk superconducting resonator including a bulk superconducting material and being embedded in the first dielectric substrate, wherein the bulk superconducting resonator has a taper at an edge thereof.

2. The superconducting filter device as claimed in claim 1, further comprising:

a feeder that extends near the bulk superconducting resonator for signal input and signal output;

wherein the feeder includes a respective bulk superconducting material, and is embedded in the first dielectric substrate.

3. The superconducting filter device as claimed in claim 1, further comprising:

a second dielectric substrate arranged on the bulk superconducting resonator embedded in the first dielectric substrate.

4. The superconducting filter device as claimed in claim 1, further comprising:

a plurality of superconducting resonators including the superconducting resonator, each of the plurality of bulk superconductor resonators are embedded in the first dielectric substrate and include a respective bulk superconducting material; and a plurality of coupling lines, each of the coupling lines couples two adjacent ones of the plurality of bulk superconducting resonators;

wherein the coupling lines include a respective bulk superconducting material, and are embedded in the first dielectric substrate.

5. A superconducting filter device, comprising:

a first dielectric substrate;

a bulk superconducting resonator including a bulk superconducting material and being embedded in the first dielectric substrate; and a feeder that extends near the bulk superconducting resonator for signal input and signal output;

wherein the feeder includes a bulk superconducting material, and is embedded in the first dielectric substrate.

6. The superconducting filter device as claimed in claim 5, further comprising:

a plurality of superconducting resonators including the superconducting resonator, each of the plurality of bulk superconducting resonators are embedded in the first dielectric substrate and include a respective bulk superconducting material; and a plurality of coupling lines, each of the coupling lines couple two adjacent ones of the plurality of bulk superconducting resonators, wherein the coupling lines include a respective bulk superconducting material, and are embedded in the first dielectric substrate.

7. The superconducting filter device as claimed in claim 5, further comprising:

a second dielectric substrate arranged on the bulk superconducting resonator embedded in the first dielectric substrate.

8. The superconducting filter device as claimed in claim 5, wherein the bulk superconducting resonator has a taper at an edge thereof.

9. A superconducting filter device production method, comprising:

fabricating a superconducting disk having a thickness from a cylindrical bulk superconducting material;

forming a depression portion in a first dielectric substrate to have a size substantially equivalent to a size of the superconducting filter disk; and embedding the superconducting filter disk in the depression portion to form an embedded bulk superconducting resonator, wherein the fabricating a superconducting disk includes forming a taper at an edge of the superconducting disk.

10. The method as claimed in claim 9, wherein the depression portion is fabricated by laser machining or ultrasonic machining.

11. The method as claimed in claim 9, further comprising:

cutting out a feeder for signal input and signal output from the bulk superconducting material;

forming a groove extending near the depression portion corresponding to a shape of the feeder in the first dielectric substrate; and embedding the feeder in the groove.

12. The method as claimed in claim 9, wherein the taper has a curvature radius of 0.2 mm.

13. The method as claimed in claim 9, further comprising:

arranging a second dielectric substrate on the bulk superconducting resonator embedded in the first dielectric substrate.

14. A superconducting filter device production method, comprising:

fabricating a superconducting disk having a thickness from a cylindrical bulk superconducting material;

forming a depression portion in a first dielectric substrate to have a size substantially equivalent to a size of the superconducting filter disk;

embedding the superconducting filter disk in the depression portion to form an embedded bulk superconducting resonator;

cutting out a feeder for signal input and signal output from the bulk superconducting material;

forming a groove extending near the depression portion corresponding to a shape of the feeder in the first dielectric substrate; and embedding the feeder in the groove.

15. The method as claimed in claim 14, wherein the depression portion is fabricated by laser machining or ultrasonic machining.

16. The method as claimed in claim 14, wherein the fabricating a superconducting disk includes forming a taper at an edge of the superconducting disk.

17. The method as claimed in claim 14, wherein the groove is fabricated by laser machining or ultrasonic machining.

18. The method as claimed in claim 14, further comprising:

arranging a second dielectric substrate on the bulk superconducting resonator embedded in the first dielectric substrate.

* * * * *